US009612557B2

(12) United States Patent
Yuasa

(10) Patent No.: US 9,612,557 B2
(45) Date of Patent: Apr. 4, 2017

(54) IMAGE FORMING APPARATUS

(71) Applicant: CANON KABUSHIKI KAISHA, Tokyo (JP)

(72) Inventor: Takao Yuasa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/858,124

(22) Filed: Sep. 18, 2015

(65) Prior Publication Data

US 2016/0085193 A1 Mar. 24, 2016

(30) Foreign Application Priority Data

Sep. 22, 2014 (JP) ..... 2014-192143

(51) Int. Cl.
*G03G 15/00* (2006.01)
*G03G 15/01* (2006.01)

(52) U.S. Cl.
CPC ..... *G03G 15/5008* (2013.01); *G03G 15/0136* (2013.01); *G03G 15/50* (2013.01)

(58) Field of Classification Search
CPC ..... G03G 15/0131; G03G 15/0136; G03G 15/0178
See application file for complete search history.

(56) References Cited

U.S. PATENT DOCUMENTS

| | | | | |
|---|---|---|---|---|
| 6,470,166 | B2 | 10/2002 | Mizoguchi et al. | |
| 2002/0018673 | A1 | 2/2002 | Mizoguchi et al. | |
| 2003/0164971 | A1* | 9/2003 | Kidani | H04N 1/46 358/1.13 |
| 2015/0063879 | A1 | 3/2015 | Yuasa | |

FOREIGN PATENT DOCUMENTS

| | | | |
|---|---|---|---|
| JP | 2004-246571 | A | 9/2004 |
| JP | 2007-011151 | A | 1/2007 |

* cited by examiner

*Primary Examiner* — Gregory H Curran
(74) *Attorney, Agent, or Firm* — Fitzpatrick, Cella, Harper & Scinto

(57) ABSTRACT

An image forming apparatus includes an all contact full color mode and an all contact monochrome mode. During an image forming job in which image forming is successively performed on a plurality of recording materials, in case that an image is formed using only the first image forming unit with the first image forming unit and the second image forming unit being in contact with the intermediate transfer member after an image has been formed using both of the first image forming unit and the second image forming unit, the controller determines whether the all contact full color mode or the all contact monochrome mode is performed based on an image forming speed to be performed or other criteria.

14 Claims, 20 Drawing Sheets

FIG. 5

| MODE | DRUM DRIVING | | CHARGING HIGH VOLTAGE | | DEVELOPING DRIVING | | DEVELOPING HIGH VOLTAGE | | PRIMARY TRANSFER ROLLER SEPARATION | PRIMARY TRANSFER ROLLER HIGH VOLTAGE | |
|---|---|---|---|---|---|---|---|---|---|---|---|
| | YMC | Bk | YMC | Bk | YMC | Bk | YMC | Bk | | YMC | Bk |
| FULL COLOR | ON | ON | ON | ON | ON | ON | ON | ON | ALL CONTACT | ON | ON |
| MONOCHROME | OFF | ON | OFF | ON | OFF | ON | OFF | ON | Bk CONTACT | OFF | ON |
| ALL CONTACT MONOCHROME | ON | ON | ON | ON | OFF | ON | ON | ON | ALL CONTACT | ON | ON |

*FIG. 8*

FOGGING AND CARRIER ADHESION FOR Vback VALUE

| Vback | 75V | 100V | 125V | 150V | 175V | 200V |
|---|---|---|---|---|---|---|
| FOGGING | × | △ | △ | ○ | ○ | ○ |
| CARRIER ADHESION | ○ | ○ | ○ | ○ | △ | × |

○ NO OCCURRENCE
△ OCCURRENCE(SLIGHT)
× OCCURRENCE

*FIG. 9*

PROCESS SPEED AND DEVELOPER AMOUNT ON DEVELOPING SLEEVE

| PROCESS SPEED | 200mm/s | 135mm/s | 100mm/s |
|---|---|---|---|
| DEVELOPER AMOUNT ON DEVELOPING SLEEVE | 23mg/cm$^2$ | 27mg/cm$^2$ | 30mg/cm$^2$ |

*FIG. 10*

FOGGING IN ALL CONTACT MONOCHROME MODE FOR PROCESS SPEEDS

| PROCESS SPEED | 200mm/s | 135mm/s | 100mm/s |
|---|---|---|---|
| FOGGING | ○ | △ | × |

○ NO OCCURRENCE
△ OCCURRENCE (SLIGHT)
× OCCURRENCE

*FIG. 11*

Vback SETTING FOR PROCESS SPEEDS

| PROCESS SPEED | 200mm/s | 135mm/s | 100mm/s |
|---|---|---|---|
| Vback | 150V | 175V | 175V |
| FOGGING | ○ | ○ | △ |

○ NO OCCURRENCE
△ OCCURRENCE (SLIGHT)
× OCCURRENCE

*FIG. 13*

FOGGING IN ALL CONTACT MONOCHROME MODE FOR MOISTURE CONTENTS

| MOISTURE CONTENT | LESS THAN $10g/m^3$ | GREATER THAN OR EQUAL TO $10g/m^3$ AND LESS THAN $15g/m^3$ | GREATER THAN OR EQUAL TO $15g/m^3$ AND LESS THAN $20g/m^3$ | GREATER THAN OR EQUAL TO $20g/m^3$ |
|---|---|---|---|---|
| FOGGING | ○ | ○ | △ | × |

○ NO OCCURRENCE
△ OCCURRENCE (SLIGHT)
× OCCURRENCE

FIG. 14

Vback SETTING FOR MOISTURE CONTENTS

| MOISTURE CONTENT | LESS THAN 10g/m$^3$ | GREATER THAN OR EQUAL TO 10g/m$^3$ AND LESS THAN 15g/m$^3$ | GREATER THAN OR EQUAL TO 15g/m$^3$ AND LESS THAN 20g/m$^3$ | GREATER THAN OR EQUAL TO 20g/m$^3$ |
|---|---|---|---|---|
| Vback | 150V | 150V | 175V | 175V |
| FOGGING | ○ | ○ | ○ | △ |

○ NO OCCURRENCE
△ OCCURRENCE (SLIGHT)
× OCCURRENCE

*FIG. 15*

FOGGING IN ALL CONTACT MONOCHROME MODE FOR TONER RATIOS

| TONER RATIO | LESS THAN 8% | GREATER THAN OR EQUAL TO 8% AND LESS THAN 10% | GREATER THAN OR EQUAL TO 10% AND LESS THAN 12% | GREATER THAN OR EQUAL TO 12% |
|---|---|---|---|---|
| FOGGING | ○ | ○ | △ | × |

○ NO OCCURRENCE
△ OCCURRENCE (SLIGHT)
× OCCURRENCE

FIG. 16

Vback SETTING FOR TONER RATIOS

| TONER RATIO | LESS THAN 8% | GREATER THAN OR EQUAL TO 8% AND LESS THAN 10% | GREATER THAN OR EQUAL TO 10% AND LESS THAN 12% | GREATER THAN OR EQUAL TO 12% |
|---|---|---|---|---|
| Vback | 150V | 150V | 175V | 175V |
| FOGGING | ○ | ○ | ○ | △ |

○ NO OCCURRENCE
△ OCCURRENCE (SLIGHT)
× OCCURRENCE

FIG. 17

FOGGING IN ALL CONTACT MODE FOR NUMBER OF SHEETS USED IN DEVELOPING DEVICE

| NUMBER OF SHEETS | LESS THAN 5000 SHEETS | GREATER THAN OR EQUAL TO 5000 SHEETS AND LESS THAN 10000 SHEETS | GREATER THAN OR EQUAL TO 10000 SHEETS AND LESS THAN 20000 SHEETS | GREATER THAN OR EQUAL TO 20000 SHEETS |
|---|---|---|---|---|
| FOGGING | ○ | ○ | △ | × |

○ NO OCCURRENCE
△ OCCURRENCE (SLIGHT)
× OCCURRENCE

FIG. 18

Vback SETTING FOR NUMBER OF SHEETS USED IN DEVELOPING DEVICE

| NUMBER OF SHEETS | LESS THAN 5000 SHEETS | GREATER THAN OR EQUAL TO 5000 SHEETS AND LESS THAN 10000 SHEETS | GREATER THAN OR EQUAL TO 10000 SHEETS AND LESS THAN 20000 SHEETS | GREATER THAN OR EQUAL TO 20000 SHEETS |
|---|---|---|---|---|
| Vback | 150V | 150V | 175V | 175V |
| FOGGING | ○ | ○ | ○ | △ |

○ NO OCCURRENCE
△ OCCURRENCE (SLIGHT)
× OCCURRENCE

FIG. 19

WHETHER ALL CONTACT MONOCHROME MODE IS PERFORMED OR NOT FOR PROCESS SPEEDS

| PROCESS SPEED | 200mm/s | 135mm/s | 100mm/s |
|---|---|---|---|
| ALL CONTACT MONOCHROME MODE | PERFORMED | PERFORMED | NOT PERFORMED |

IMAGE FORMING APPARATUS

BACKGROUND OF THE INVENTION

Field of the Invention

The present invention relates to an image forming apparatus such as a copying machine, a printer, a facsimile machine, and a multifunction peripheral having a plurality of these functions.

Description of the Related Art

With the high speed of an image forming apparatus, as a full color image forming apparatus, the configuration in which a plurality of image forming units are disposed side by side along the belt member and respective color image forming operations are processed in parallel has become the mainstream. For example, an electro-photographic image forming apparatus employs a full color tandem system using an intermediate transfer belt.

In the full color tandem system, a plurality of image forming units disposed side by side are used. The toner images having different colors formed by these image forming units are primarily transferred to the intermediate transfer belt in an overlapping manner. Furthermore, after the toner images which have been transferred to the intermediate transfer belt are secondarily transferred to the recording material altogether, a full color image is obtained by fixing the toner images on the recording material.

In the image forming unit, the surface of the photosensitive drum is charged by a charging roller. The surface of the charged photosensitive drum is exposed by a laser scanner and a latent image is formed on the surface of the photosensitive drum. Then, the latent image on the surface of the photosensitive drum is developed into a toner image by a developing device. The developed toner image is transferred to an intermediate transfer belt by a primary transfer roller. Further, the toner remaining on the photosensitive drum after the primary transfer is removed by the cleaning member.

For the image forming apparatus of a full color tandem system, it is necessary to suppress the short life of the image forming unit of a color that is not used during the monochrome image formation. Therefore, in a general configuration of the image forming apparatus, a full color mode in which the intermediate transfer belt is in contact with all the image forming units and a monochrome mode in which the intermediate transfer belt is in contact only with the image forming unit of black are switched (see, for example, U.S. Patent Application Publication No. 2002/018673 A1).

Meanwhile, in such an image forming apparatus, when performing a print job in which a full color image and a monochrome image are mixed, there is a problem that a downtime associated with the switching of the full color mode and the monochrome mode frequently occurs.

Japanese Patent Laid-Open No. 2004-246571 discloses the configuration in which when the printing time can be shortened if a monochrome image is printed using a full color mode, the monochrome image is processed as a full color image.

Japanese Patent Laid-Open No. 2007-11151 discloses the configuration in which developing devices for color are stopped when a monochrome image is printed using a full color mode so that the short life of the image forming units for color is suppressed without generating a downtime.

However, as in the prior art described above, when the images are formed by a part of the developing units with the other developing units being stopped, the following problem occurs.

That is, a study by the inventor of the present invention reveals that when a developing unit is stopped and only the photosensitive drum is rotated, the toner which is present in the opposed portion between the developing unit which is stopped and the photosensitive drum is scraped off by the photosensitive drum and the so-called "fogging image" occurs. This phenomenon will be described later in detail.

SUMMARY OF THE INVENTION

The present invention provides an image forming apparatus which prevents a downtime, suppresses a short life of an image forming unit and suppresses defective images when performing a print job in which a full color image and a monochrome image are mixed.

An image forming apparatus of the present invention, comprises:

- a first image forming unit;
- a second image forming unit;
- an intermediate transfer member on which an image formed by the first image forming unit and the second image forming unit is transferred; and
- a controller configured to control the first image forming unit and the second image forming unit,
- wherein the first image forming unit and the second image forming unit respectively includes:
  - an image bearing member; and
  - a developing device configured to develop a latent image formed on the image bearing member,
- wherein the controller can perform the following modes:
  - (1) an all contact full color mode in which image formation is performed using only the first image forming unit with the first image forming unit and the second image forming unit being in contact with the intermediate transfer member, the image bearing member and the developing device of the second image forming unit being driven in the all contact full color mode; and
  - (2) an all contact monochrome mode in which image formation is performed using only the first image forming unit with the first image forming unit and the second image forming unit being in contact with the intermediate transfer member, the image bearing member of the second image forming unit being driven and the developing device of the second image forming unit being stopped in the all contact monochrome mode, and
- wherein during an image forming job in which image forming is successively performed on a plurality of recording materials, in case that an image is formed using only the first image forming unit with the first image forming unit and the second image forming unit being in contact with the intermediate transfer member after an image has been formed using both of the first image forming unit and the second image forming unit, the controller determines whether the all contact full color mode or the all contact monochrome mode is performed based on an image forming speed to be performed.

Further features of the present invention will become apparent from the following description of exemplary embodiments with reference to the attached drawings.

BRIEF DESCRIPTION OF THE DRAWINGS

FIG. 4A shows all contact state and FIG. 4B shows Bk contact state.

FIG. 5 is a table showing image forming modes of the first embodiment of the present invention.

FIG. 6A shows the case of the switching of the full color mode and the monochrome mode. FIG. 6B shows the case of forming all the images in full color mode. FIG. 6C shows the case of forming images in all contact monochrome mode.

FIG. 8 is a table showing the relationship between a developing high voltage, and fogging and carrier adhesion in the first embodiment of the present invention.

FIG. 9 is a table showing the relationship between the process speed and the amount of developer on the developing sleeve in the first embodiment of the present invention.

FIG. 10 is a table showing the relationship between the basis weight of the recording material and fogging.

FIG. 11 is a table showing the relationship between the setting of a developing high voltage and fogging for respective process speeds.

FIG. 13 is a table for explaining the relationship between moisture content in the image forming apparatus and fogging in the second embodiment of the present invention.

FIG. 14 is a table showing the setting of a developing high voltage and fogging for respective moisture contents in the image forming apparatus of the second embodiment of the present invention.

FIG. 15 is a table showing the relationship between a toner ratio of the developer and fogging in the third embodiment of the present invention.

FIG. 16 is a table showing the relationship between the setting of a developing high voltage and fogging for respective toner ratios in the third embodiment of the present invention.

FIG. 17 is a table showing the relationship between a number of sheets used in the developing device and fogging in the fourth embodiment of the present invention.

FIG. 18 is a table showing the relationship between the setting of a developing high voltage and fogging for respective numbers of the sheets used in the developing device of the fourth embodiment of the present invention.

FIG. 19 is a table showing the relationship between a process speed and whether all contact monochrome mode is performed or not in the sixth embodiment of the present invention.

DESCRIPTION OF THE EMBODIMENTS

Hereinafter, with reference to the accompanying drawings, embodiments of the present invention will be described in detail.

<First Embodiment> Hereinafter, with reference to the drawings, an image forming apparatus according to an embodiment of the present invention will be described in detail. Although only the main part of the formation and transfer of the toner image will be described in the present embodiment, the present invention can be implemented in a variety of applications such as a printer, a copying machine, a facsimile machine, and a multifunction peripheral by adding necessary equipment and a housing structure.

Figure 1:
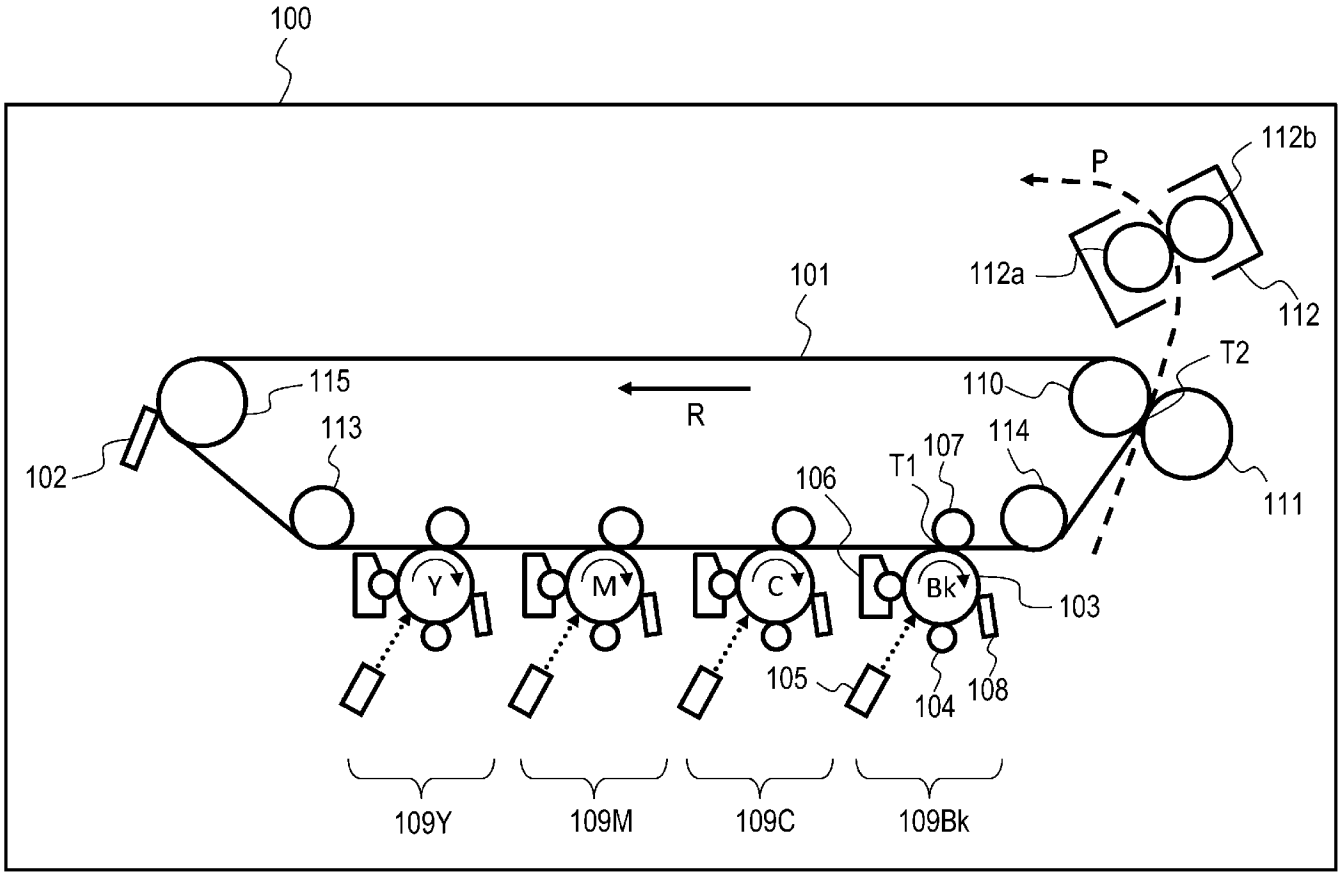
FIG. 1 is a view showing the schematic configuration of an image forming apparatus of the first embodiment of the present invention.

(Schematic Configuration of Image Forming Apparatus) FIG. 1 is a view showing the schematic configuration of an image forming apparatus.

As shown in the figure, the image forming apparatus 100 is a full color printer of a tandem type using intermediate transfer system in which the image forming units 109Y, 109M, 109C and 109Bk for yellow, magenta, cyan and black are respectively disposed along the intermediate transfer belt 101 (intermediate transfer member).

A yellow toner image is formed by the image forming units 109Y on the photosensitive drum 103 (image bearing member) and is transferred to the intermediate transfer belt 101. In the image forming unit 109M, a magenta toner image is formed on the photosensitive drum 103 in a similar process as in the image forming unit 109Y and the magenta toner image is transferred to the intermediate transfer belt 101 overlapping with the yellow toner image which has been formed on the intermediate transfer belt 101. In the image forming units 109C and 109Bk, a cyan toner image and a black toner image are formed respectively in a similar process as in the image forming unit 109Y and are transferred to the intermediate transfer belt 101 in a sequentially superimposed manner.

The toner images of four colors borne on the intermediate transfer belt 101 are conveyed to the secondary transfer portion T2 where the toner images are secondarily transferred to the recording material P altogether. The recording material P to which the toner images of four colors have been secondarily transferred is separated from the intermediate transfer belt 101 by curvature and is fed to the fixing device 112. The recording material P is heated and pressed by the fixing roller 112*a* and the pressure roller 112*b* in the fixing device 112 whereby the toner is melted and the image is fixed on the surface of the recording material P. Thereafter, the recording material P is discharged from the apparatus body.

The image forming units 109Y, 109M, 109C and 109Bk have substantially the same configuration except for different colors yellow, magenta, cyan and black used respectively in the developing devices 106 (developing means).

In the following, an explanation will be made of the process for forming a toner image in the image forming unit 109BK in which black toner is used and duplicate description for the other image forming units 109Y, 109M and 109C will be omitted. The suffixes Y, M, C and Bk which respectively indicate toner colors of yellow, magenta, cyan and black will be omitted as appropriate.

In the image forming unit 109Bk, the charging roller 104 (charging device), an exposure device 105 (electrostatic latent image forming device), the developing device 106, the primary transfer roller 107 and the photosensitive drum cleaning blade 108 are disposed around the photosensitive drum 103. The photosensitive drum 103 has a photosensitive layer with negative charging polarity on its surface and rotates in the direction indicated by the arrow at a predetermined process speed. A negative DC voltage is applied to the charging roller 104 so that the surface of the photosensitive drum 103 is charged at a negative polarity. The exposure device 105 scans the surface of the photosensitive drum 103 with the laser beam which has been ON-OFF modulated by the scanning image data generated from the color separation image of black and writes an electrostatic latent image on the surface of the photosensitive drum 103.

The intermediate transfer belt 101 is disposed such that it can be in contact with and separated from the image forming units 109Y, 109M, 109C and 109Bk.

Figure 2:
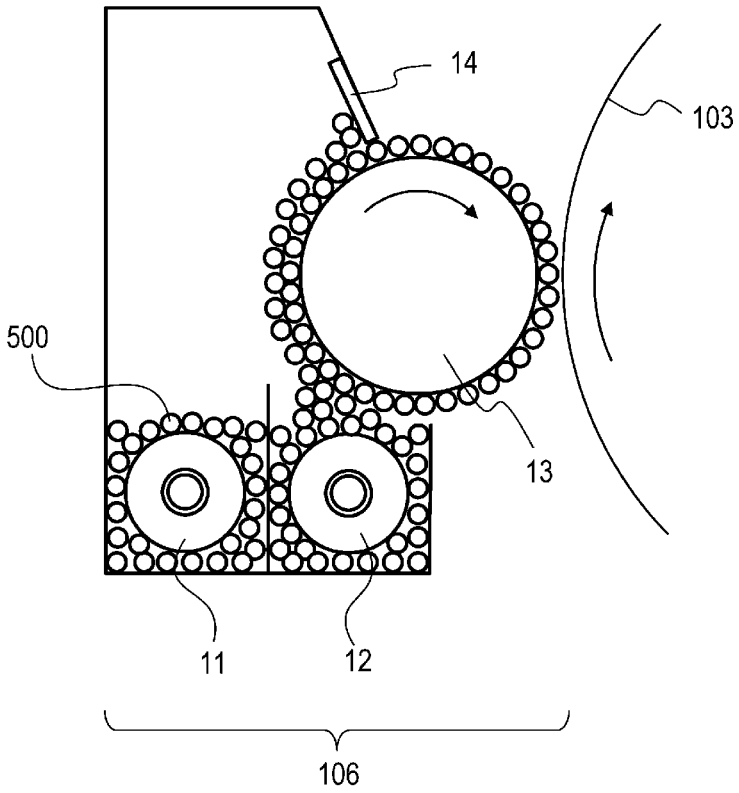
FIG. 2 is a view showing the schematic configuration of a developing device of the first embodiment of the present invention.

(Configuration of the developing device) FIG. 2 is a view showing a configuration of the developing device 106 used in the image forming apparatus shown in FIG. 1.

As shown in the figure, in the developing device 106, the two-component developer 500 containing non-magnetic toner with negative charging polarity and magnetic carrier is frictionally charged by the stirring member 11. The developer 500 is conveyed by the conveying member 12 and is borne on the developing sleeve 13. After the thickness of the developer 500 borne on the developing sleeve 13 has been restricted by the restricting blade 14, the developer 500 is conveyed to the opposing portion between the developing sleeve 13 and the photosensitive drum 103. The developing sleeve 13 is held such that there exists a predetermined distance between the developing sleeve 13 and the photosensitive drum 103. By applying an oscillating voltage obtained by superposing an AC voltage on a negative DC voltage to the developing sleeve 13, the negatively charged toner is moved to an exposed portion of the photosensitive drum 103, which has been relatively charged with positive polarity, whereby a latent image is reversely developed.

As shown in FIG. 1, the primary transfer portion T1 is formed between the photosensitive drum 103 and the intermediate transfer belt 101 by the primary transfer roller 107. By applying a positive DC voltage to the primary transfer roller 107, the toner image borne on the photosensitive drum 103 is primarily transferred to the intermediate transfer belt 101. The photosensitive drum cleaning blade 108 is in contact with the photosensitive drum 103 in the direction opposed to the driving direction of the photosensitive drum 103 for collecting transfer residual toner remaining on the photosensitive drum 103.

The secondary transfer roller 111 abuts against the outer surface of the intermediate transfer belt 101 between the image forming unit 109Bk and the transfer cleaning blade 102 in the conveying direction of the toner image. The secondary transfer roller 111 abuts against the intermediate transfer belt 101 the inner surface of which is supported by the driving roller 110 to form the secondary transfer portion T2. By applying a positive DC voltage to the secondary transfer roller 111, a full color toner image borne on the intermediate transfer belt 101 is secondarily transferred to the recording material P. The transfer cleaning blade 102 is opposed to the tension roller 115 and is in contact with the intermediate transfer belt 101 in the driving direction of the intermediate transfer belt 101 to collect transfer residual toner remaining on the intermediate transfer belt 101.

The intermediate transfer belt 101 is a belt member that is driven and conveyed in the direction of the arrow R. The intermediate transfer belt 101 is stretched by the driving roller 110 (driving member), the stretching rollers 113 and 114 (stretching members) and the tension roller 115 which provides the intermediate transfer belt 101 with a predetermined tension. The drive roller 110 has the function of a secondary transfer inner roller which is disposed in the secondary transfer portion T2. The number of rollers that stretch the intermediate transfer belt 101 is not limited to the configuration of FIG. 1.

Figure 3:
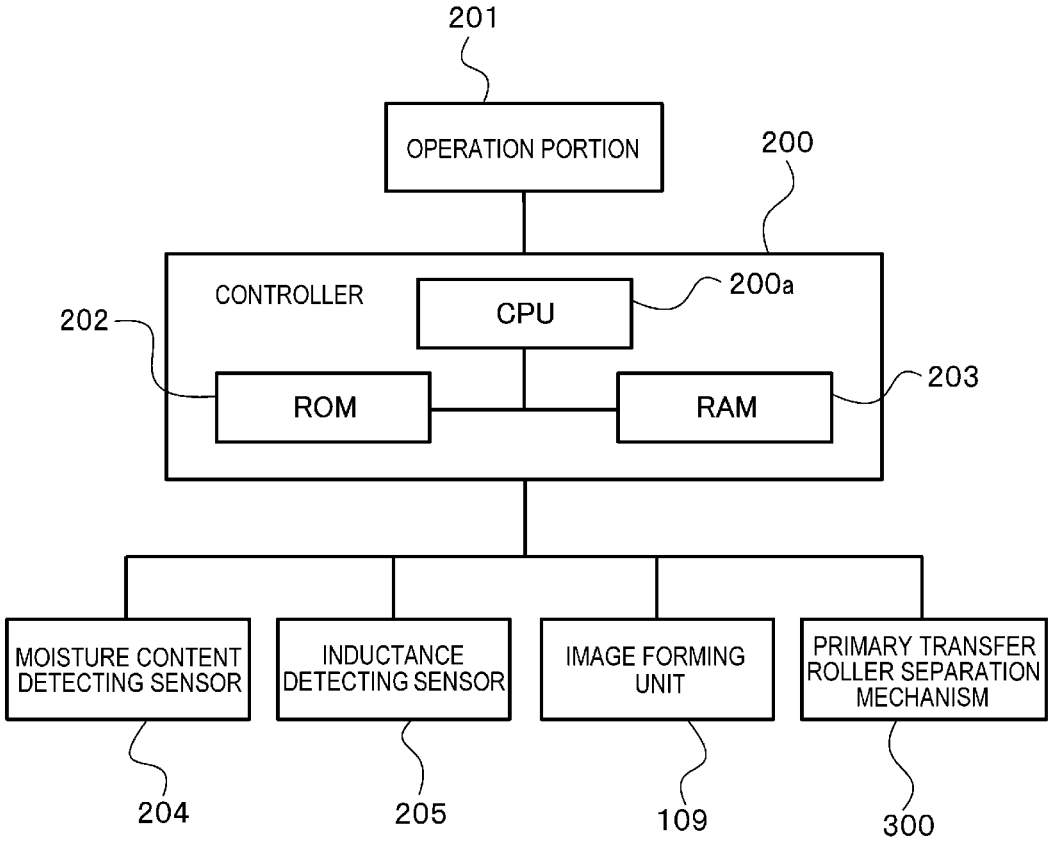
FIG. 3 is a block diagram showing the configuration of a control system of the image forming apparatus of the first embodiment of the present invention.

(Configuration of the control system) FIG. 3 is a block diagram showing a control system of the image forming apparatus 100. A user starts a print job by operating the operation portion 201. The controller 200 receives signals from the operation portion 201 and operates various devices of the image forming apparatus 100. The controller 200 has the CPU 200*a*, the ROM 202 and the RAM 203. Setting data required for various controls are stored in the ROM 202 and the data are read out by the CPU 200*a* when necessary. Various data which can be changed with the operation of the image forming apparatus such as a number of printed sheets are temporarily stored in the RAM 203 and are used for various controls. Further, the image forming apparatus 100 has the moisture content detecting sensor 204 and the inductance detecting sensor 205, which are executed by the controller 200 if necessary to respectively detect a moisture content in the image forming apparatus 100 and a toner ratio of the developer. Furthermore, the image forming apparatus 100 has the primary transfer roller separation mechanism 300.

The image forming apparatus 100 is operable at a plurality of process speeds. For example, when the basis weight of the recording material P is large, it is possible to operate at a process speed slower than usual to ensure fixation of the fixing device 112. Another configuration may be that a user can change to a slower process speed from the operation portion 201 when the user wishes to obtain a high resolution image.

Figure 4A:
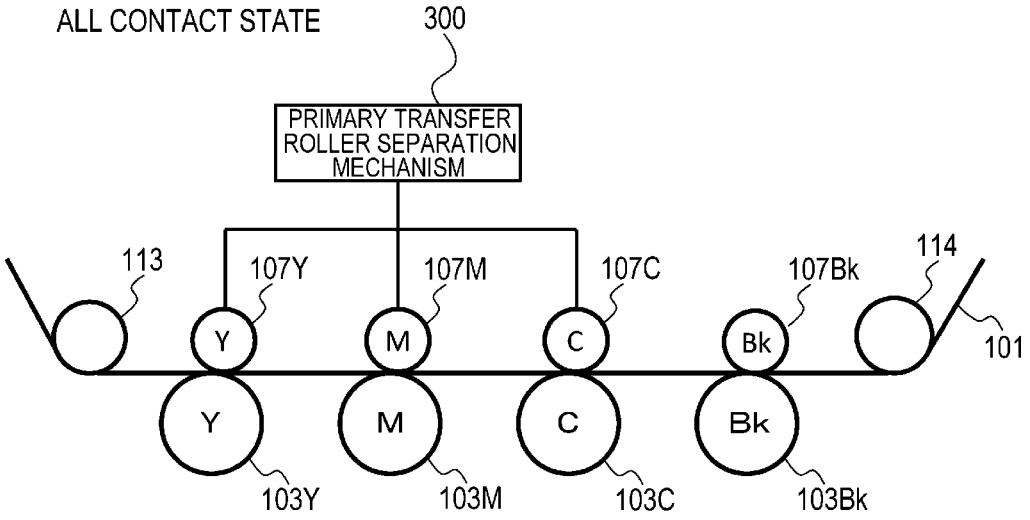
FIGS. 4A and 4B are diagrams for explaining the operation of the primary transfer roller separating mechanism of the first embodiment of the present invention.
Figure 4B:
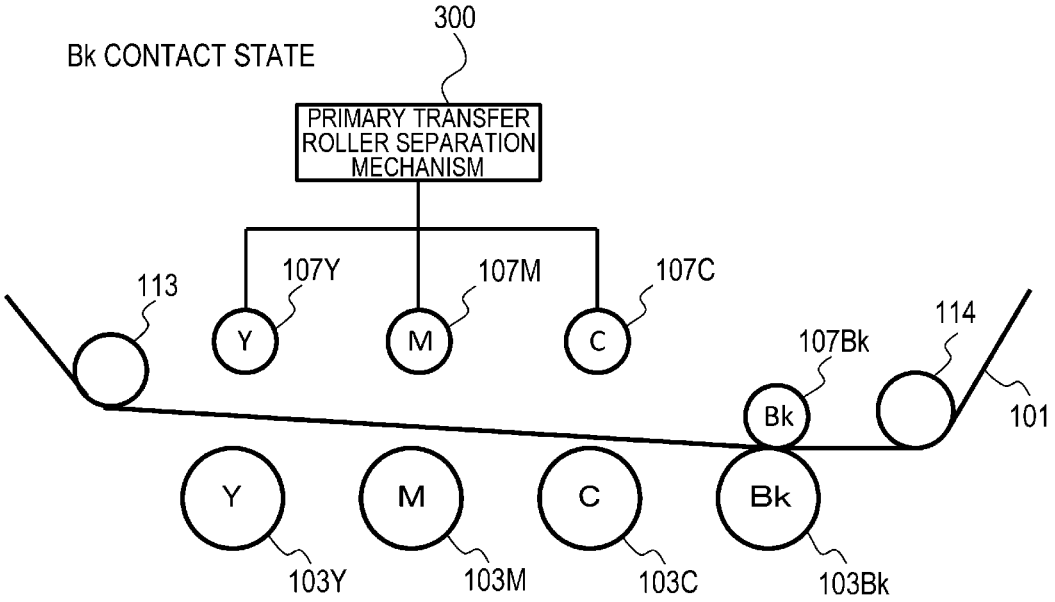

(Image forming modes) FIGS. 4A and 4B are diagrams showing a separating operation of the primary transfer roller by the primary transfer roller separation mechanism 300.

As shown in these figures, the image forming apparatus 100 moves up and down the primary transfer rollers 107Y, 107M and 107C for colors by the primary transfer roller separation mechanism 300. With this configuration, the intermediate transfer belt 101 can be in contact with and separated from the photosensitive drums 103Y, 103M and 103C for colors.

In all contact state indicated in FIG. 4A, the intermediate transfer belt 101 is in contact with all the photosensitive drums 103Y, 103M, 103C and 103Bk. On the other hand, in Bk contact state indicated in FIG. 4B, the intermediate transfer belt 101 is in contact only with the photosensitive drum 103Bk and the other photosensitive drums 103Y, 103M and 103C are separated from the intermediate transfer belt 101.

FIG. 5 is a table showing the details of image forming modes of the image forming apparatus 100.

As shown in the figure, the image forming apparatus 100 can perform three image forming modes including a full color mode, a monochrome mode (a second monochrome mode) and an all contact monochrome mode (a first monochrome mode).

In the full color mode (a first all contact mode), the primary transfer roller separation mechanism 300 is in the all contact state, the image forming apparatus 100 forms a full color image on the intermediate transfer belt 101 with all the image forming units 109Y, 109M, 109C and 109Bk. The full color mode is not a mode in which every image forming unit among all the image forming units is used, but a mode in which all the image forming units are in a state capable of forming an image. Therefore, in the full color mode, other than the case of forming a full color image using all colors, there is the case of forming an image using a single black color for example. The difference between the full color mode and the all contact monochrome mode which will be described later is whether the driving of the developing devices 106Y, 106M and 106C for colors are stopped or not.

In the monochrome mode (partial separation mode), the primary transfer roller separation mechanism 300 is in the Bk contact state and a monochrome image is formed on the intermediate transfer belt 101 by using only the image forming unit 109Bk (a single image forming unit). In this case, the image forming units 109Y, 109M and 109C for colors (a plurality of image forming units other than the single image forming unit of the plurality of image forming units) are not driven and even a high voltage is not applied to these image forming units 109Y, 109M and 109C.

On the other hand, although in the all contact monochrome mode (all contact monochrome mode, second all contact mode), the primary transfer roller separation mechanism 300 is in the all contact state, a monochrome image is formed on the intermediate transfer belt 101 by using only the image forming unit 109Bk. In this case, the driving of the photosensitive drums 103Y, 103M and 103C for colors and the application of a high voltage to the image forming units 109Y, 109M and 109C for colors are performed as usual and only the driving of the developing devices 106Y, 106M and 106C for colors is stopped. Another configuration may be taken that an only DC voltage is applied to the developing sleeves 13Y, 13M and 13C without applying AC voltage.

Figure 6A:
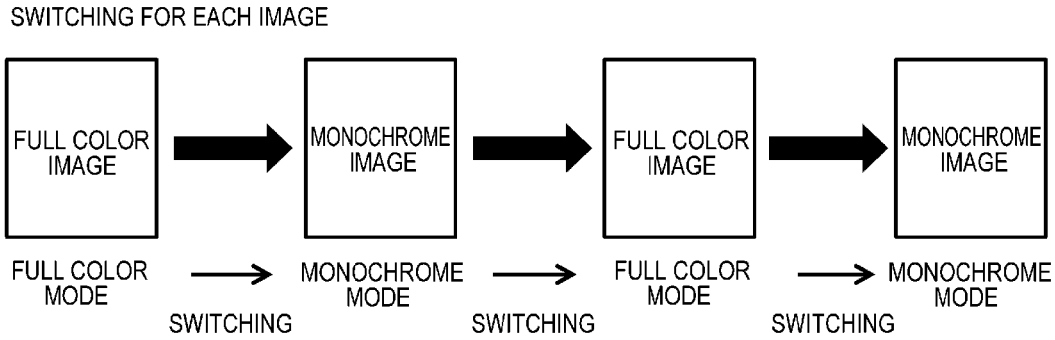
FIGS. 6A, 6B and 6C are diagrams for explaining the print job in which a full color image and a monochrome image are mixed in the first embodiment of the present invention.
Figure 6B:
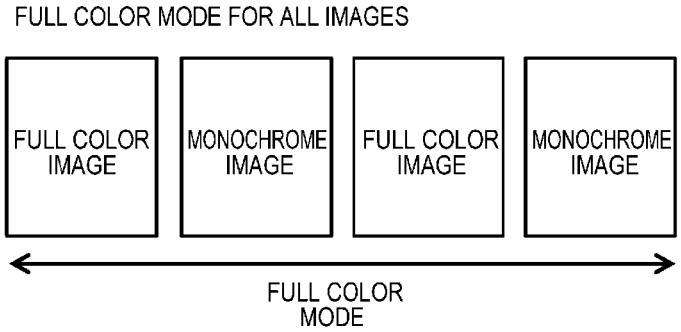
Figure 6C:
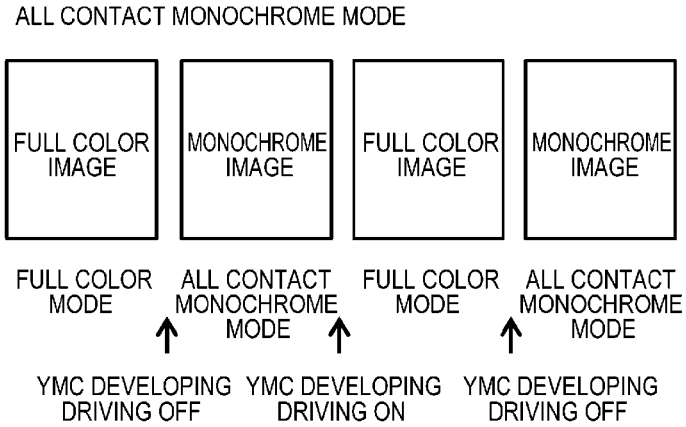

FIGS. 6A, 6B and 6C are diagrams for explaining the case of performing a print job in which a full color image and a monochrome image are mixed. As a specific example, the case will be described where four sheets are continuously printed in the order of a full color image, a monochrome image, a full color image and a monochrome image.

As shown in FIG. 6A, when the full color mode and the monochrome mode are switched for each image, the mode switching occurs three times during the printing of the four images. When the full color mode is switched to the monochrome mode, it is necessary to stop the driving and the high voltage application of the image forming units 109Y, 109M and 109C for colors and to change the state of the primary transfer roller separation mechanism 300 from the all contact mode to the Bk contact mode. When the monochrome mode is switched to the full color mode, it is necessary to start the driving and the high voltage application of the image forming units 109Y, 109M and 109C for colors and to change the state of the primary transfer roller separation mechanism 300 from the Bk contact mode to the all contact state. Thus, when the full color mode and the monochrome mode are switched for each image, a large amount of downtime occurs.

When all images are formed in the full color mode as shown in FIG. 6B, downtime does not occur. However, a short life of the photosensitive drums 103Y, 103M and 103C, the developing devices 106Y, 106M and 106C is invited since the image forming units 109Y, 109M and 109C which are not essentially necessary for forming a monochrome image are used. In particular, the deterioration of the developer is remarkable under such usage.

On the other hand, as shown in FIG. 6C, although the mode switching occurs three times while printing four sheets of image when a monochrome image is formed in the all contact monochrome mode, the operation at this time is only the stoppage and the driving of the developing sleeves 13Y, 13M and 13C. Even when the all contact monochrome mode is switched to the full color mode, downtime for stabilizing the surface potential of the photosensitive drums 103Y, 103M and 103C does not occur since the high voltage output to the image forming units 109Y, 109M and 109C for colors has not been stopped. Moreover, deterioration of the developer does not occur since the driving of the developing devices 106Y, 106M and 106C is stopped when a monochrome image is formed, which is effective for suppressing a short life of the developing devices 106Y, 106M and 106C.

The present embodiment employs a method using the all contact monochrome mode indicated in FIG. 6C. However, when more sheets of monochrome image are made successively than a predetermined number, the monochrome mode may be performed in the middle of the processing, taking into account a short life of the photosensitive drums 103Y, 103M and 103C for colors.

(Image fogging) In the all contact monochrome mode, "image fogging" sometimes occurs where toner of yellow, magenta or cyan is placed on a monochrome image formed by the image forming unit 109Bk for black. Here, "fogging" means that the toner is placed on the white background on which an image is not originally intended to be made.

Figure 7:
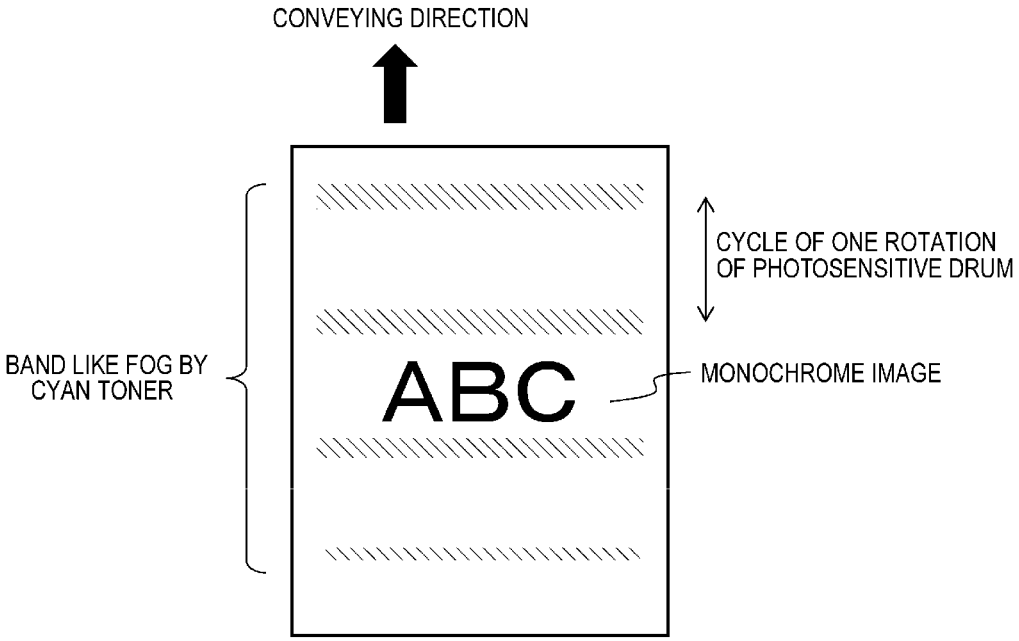
FIG. 7 is a diagram for explaining an image fogging in all contact monochrome mode in the first embodiment of the present invention.

FIG. 7 is an explanatory diagram of an image fogging, showing the case where fogging of cyan toner occurs as an example.

A study by the inventor of the present invention revealed that fogging in all contact monochrome mode often occurs in a belt-like shape in cycles of one rotation of the photosensitive drum 103. Also, image fogging is gradually thinned as the photosensitive drum 103 rotates and often disappears within a few sheets.

In the all contact monochrome mode, the developing devices 106Y, 106M and 106C are stopped and a toner image is not formed at the image forming units 109Y, 109M and 109C. A study by the inventor revealed that fogging in the all contact monochrome mode is generated because the photosensitive drum 103 physically scrapes the toner present in the opposing portion between the photosensitive drum 103 and the developing unit 106. That is, the photosensitive drum 103 tends to scrape the toner in the region in which the distance between the photosensitive drum 103 and the developing sleeve 13 is small in one rotation of the photosensitive drum 103; thereby fogging appears in a band-like shape in cycles of one rotation of the photosensitive drum.

On the other hand, fogging may be generated in the full color mode. However, a study by the inventor revealed that fogging occurs in all contact monochrome mode in the image forming unit 109 in which fogging does not occur in the full color mode. It is considered that this is because a conveying force by the driving of the developing sleeve 13 works in the full color mode but a conveying force by the driving of the developing sleeve 13 does not work in the all contact monochrome mode.

As described above, it is possible that by using the all contact monochrome mode, a short life of the image forming unit 109 can be suppressed without incurring downtime even when a print job is performed in which a full color image and a monochrome image are mixed. However, it is necessary to take some measures when fogging occurs in the all contact monochrome mode.

Fogging in all contact monochrome mode as well as in the full color mode worsens when the developer is degraded by the environment of temperature and humidity or by durability. In addition, when the amount of developer on the developing sleeve 13 is large, fogging worsens.

(Suppression of fogging image) Next, an explanation will be made to the control for ameliorating fogging by adjusting a voltage applied to the developing sleeves 13Y, 13M and 13C in the all contact monochrome mode based on the process speed of the image forming apparatus 100. First, an explanation will be made to the relationship between a voltage applied to the developing sleeve 13 and fogging in the all contact monochrome mode.

In the following, only a DC voltage is applied to the developing sleeves 13Y, 13M and 13C in the all contact monochrome mode. Further, a potential difference between the photosensitive drum 103 charged by the charging roller 104 and the developing sleeve 13 is referred to as Vback which is adjusted by adjusting a voltage applied to the developing sleeve 13. Although both of the charged photosensitive drum 103 and the developing sleeve 13 have a potential of negative polarity, Vback is defined to have a positive value when the photosensitive drum 103 is relatively high in negative potential.

In the frictionally charged developer, the toner is charged with negative polarity and carrier is charged with positive polarity. Thus, when Vback is positive, an electrostatic force is applied to the toner in the direction to the developing sleeve 13 and an electrostatic force is applied to the carrier in the direction to the photosensitive drum 103. That is, when the value of Vback is too large, the carrier cannot be held on the developing sleeve 13, carrier adhesion to the photosensitive drum 103 is generated. Conversely, when the value of Vback is small, a force applied to the toner in the direction to the developing sleeve 13 is not sufficient thereby toner is attached to the photosensitive drum 103 and fogging occurs.

FIG. 8 is a table showing the degrees of fogging and carrier adhesion in the case of changing the value of Vback of the image forming units 109Y, 109M and 109C in the all contact monochrome mode. From the table, it is understood that when Vback is small, fogging worsens and when Vback is large, carrier adhesion worsens.

That is, for improving the degree of fogging in the all contact monochrome mode, it is appropriate that the value of Vback is adjusted such that the value of Vback is higher than the value of Vback in full color mode. However, carrier adhesion is not only a cause of image defect, but also a cause of paper jam or malfunction in scattering in the body of the image forming apparatus 100. Thus, it is desirable to limit the conditions for increasing the value of Vback.

Next, an explanation will be made to the relationship between the process speed of the image forming apparatus 100 and fogging in the all contact monochrome mode. As described above, the image forming apparatus 100 has a plurality of process speeds. When it is desired to ensure the fixation of the toner image onto the recording material P with large basis weight or to obtain an image with high resolution, a slow process speed is selected.

FIG. 9 is a table showing the process speeds of the image forming apparatus 100 and the amount of developer on the developing sleeve 13 at these process speeds.

As shown in this table, it is understood that the slower the process speed of the image forming apparatus 100 becomes, the larger the amount on the developing sleeve 13 becomes. It is considered that this is because when the process speed is fast, the slip of the developer on the surface of the developing sleeve 13 increases thereby a conveying force by the developing sleeve 13 becomes lower.

FIG. 10 is a table showing results of confirming fogging in the all contact monochrome mode when Vback is 150V in plurality of process speeds using the same developing device 106.

As shown in the table, the slower the process speed of the image forming apparatus 100 becomes, the more the fogging in all contact monochrome mode worsens.

From the above results, it is understood that when the process speed of the image forming apparatus 100 is slow, it is appropriate to control for making the value of Vback higher than that in the full color mode at the slow speed. That is, when the process speed is lower than a predetermined speed, it is appropriate to control for making the value of Vback higher than that of the full color mode at the low speed.

FIG. 11 is a table showing the confirming results of fogging in the all contact monochrome mode and values of Vback set in the image forming units 109Y, 109M and 109C for respective process speeds of the image forming apparatus 100 in the present embodiment. However, the present invention is not limited to these specific values.

As shown in the table, it is understood that by increasing the value of Vback when the process speed of the image forming apparatus 100 is slow, fogging is improved in the all contact monochrome mode.

Next, an explanation will be made to an operation of control for suppressing fogging of the present embodiment, taking an example of forming an image successively in the order of a full color image and a monochrome image.

Figure 12:
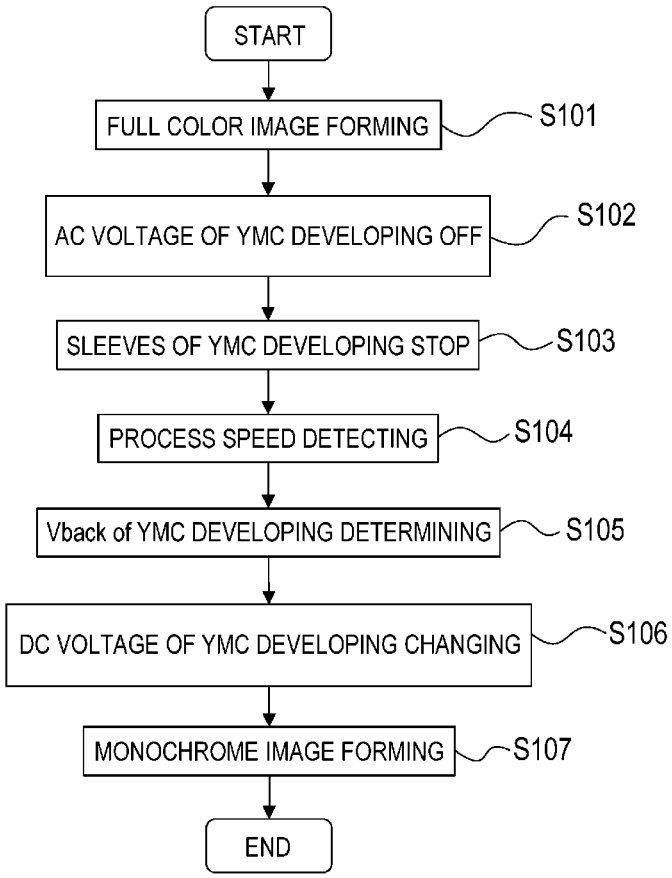
FIG. 12 is a flowchart showing an operation of a fogging countermeasure control of the first embodiment of the present invention.

FIG. 12 is a flowchart showing a fogging countermeasure control in the all contact monochrome mode of the present embodiment.

As shown in the figure, after forming a full color image in the full color mode (step S101), the controller 200 stops the application of the alternating voltage to the developing sleeves 13Y, 13M and 13C for colors (step S102). Then, the controller 200 stops the driving of the developing sleeves 13Y, 13M and 13C (step S103). Thereafter, the controller 200 checks the process speed at the time where a monochrome image is printed (step S104) and determines the value of Vback of the image forming units 109Y, 109M and 109C based on the settings shown in FIG. 11 (step S105). Based on the value of the determined Vback, the DC voltage applied to the developing sleeves 13Y, 13M and 13C is changed (step S106) and a monochrome image is formed in the all contact monochrome mode (step S107). At this time, the application of an AC voltage to the developing sleeves 13Y, 13M and 13C remains stopped.

As explained above, the value of Vback in the all contact monochrome mode is controlled based on a process speed of the image forming apparatus 100. Thus, even when performing a print job in which a full color image and a monochrome image are mixed, it is possible to suppress a short life of the image forming unit 109 and to suppress the occurrence of defective images without incurring downtime.

<Second Embodiment> Next, an image forming apparatus according to another embodiment of the present invention will be explained. This embodiment is basically equivalent to the structure of the image forming apparatus of the first embodiment. In the following, only the different part of the image forming apparatus of the first embodiment will be explained and duplicate description will be omitted.

In the present embodiment, the control for improving fogging in the all contact monochrome mode is performed by changing the value of Vback based on the moisture content in the image forming apparatus 100.

As explained above, the image forming apparatus 100 has the moisture content detecting sensor 204 and the controller 200 operates the moisture content detecting sensor 204 as needed to detect a moisture content in the image forming apparatus 100.

It is generally known that fogging deteriorates under high moisture content environment, since frictional electrification of the developer is hard to happen and the toner is less likely to be retained on the developing sleeve 13.

FIG. 13 is a table showing the results of confirming fogging in the all contact monochrome mode when the Vback is 150V using the same developing device 106 under a plurality of environments in which moisture contents are different.

FIG. 14 is a table showing the states of fogging in the all contact monochrome mode when the values of Vback of the image forming units 109Y, 109M and 109C are set for respective moisture contents in the image forming apparatus 100 based on the results indicated in FIG. 13. However, the present invention is not limited to these specific values.

It is understood that by making the value of Vback higher than that in the full color mode when the moisture content in the image forming apparatus 100 is high, fogging in the all contact monochrome mode is improved. Since fogging countermeasure control of the present embodiment can be performed by a similar flowchart of the fogging countermeasure control explained in the first embodiment, detailed description thereof will be omitted.

<Third Embodiment> Next, an image forming apparatus according to another embodiment of the present invention will be explained. This embodiment is basically equivalent to the structure of the image forming apparatus of the first embodiment. In the following, only the different part of the image forming apparatus of the first embodiment will be explained and duplicate description will be omitted.

In the present embodiment, the control for improving fogging in the all contact monochrome mode is performed by changing the value of Vback based on a toner ratio of the developer. As described above, the image forming apparatus 100 has the inductance detecting sensor 205 and the controller 200 operates the inductance detecting sensor 205 as needed to detect the toner ratio of the developer.

It is generally known that fogging deteriorates when a toner ratio of the developer is high since an electric charge per one toner particle by frictional electrification of the developer becomes low and the toner is less likely to be retained on the developing sleeve 13.

FIG. 15 is a table showing the results of confirming fogging in the all contact monochrome mode when Vback is 150V using the same developing device 106 and a plurality of developers of which toner ratios are different.

FIG. 16 is a table showing states of fogging in the all contact monochrome mode when the values of Vback of the image forming units 109Y, 109M and 109C are set for toner ratios of the developer based on the results indicated in FIG. 15 respectively. However, the present invention is not limited to these specific values.

As shown in the table, it is understood that by making the value of Vback higher than that in the full color mode when the toner ratio of the developer is high, fogging is improved in the all contact monochrome mode.

Since fogging countermeasure control of the present embodiment can be performed by a similar flowchart of the fogging countermeasure control explained in the first embodiment, detailed description thereof will be omitted.

<Fourth Embodiment> Next, an image forming apparatus according to another embodiment of the present invention will be explained. This embodiment is basically equivalent to the structure of the image forming apparatus of the first embodiment. In the following, only the different part of the image forming apparatus of the first embodiment will be explained and duplicate description will be omitted.

In the present embodiment, the control for improving fogging in the all contact monochrome mode is performed by changing the value of Vback based on the number of sheets used in the developing device 106. The controller 200 writes the number of sheets used in the developing device 106 on the RAM 203 and can refer to it as needed.

It is generally known that fogging deteriorates when the number of recording materials P used in the developing device 106 becomes large since frictional electrification becomes hard to happen and the toner is less likely to be retained on the developing sleeve 13.

FIG. 17 is a table showing the results of confirming fogging in the all contact monochrome mode when Vback is 150V for respective numbers of recording materials P used in the same developing device 106.

FIG. 18 is a table showing the states of fogging in the all contact monochrome mode when the values of Vback of the image forming units 109Y, 109M and 109C are set for respective numbers of sheets used in the developing device 106 based on the results indicated in FIG. 17. However, the present invention is not limited to these specific values.

As shown in the table, it is understood that by making the value of Vback higher than that in the full color mode when the number of sheets used in the developing device 106 is high, fogging is improved in the all contact monochrome mode.

Since the fogging countermeasure control of the present embodiment can be performed by a similar flowchart of the fogging countermeasure control explained in the first embodiment, detailed description thereof will be omitted.

<Fifth Embodiment> Next, an image forming apparatus according to another embodiment of the present invention will be explained. This embodiment is basically equivalent to the structure of the image forming apparatus of the first embodiment to fourth embodiment. In the following, only the different part of the image forming apparatus of these embodiments will be explained and duplicate description will be omitted.

In the first to fourth embodiments, based on a single parameter, the high voltage applied to the developing sleeves 13Y, 13M and 13C is controlled in the all contact monochrome mode. In this embodiment, the control is performed based on the combination parameters of the process speed of the image forming apparatus 100, the moisture content in the image forming apparatus 100, the toner ratio of the developer and the number of sheets used in the developing device 106.

For example, the control can be performed in which the value of Vback is made higher than that in the full color mode when the process speed of the image forming apparatus 100 is less than a predetermined value and the moisture content in the image forming apparatus 100 is greater than or equal to a predetermined value. That is, the control can be performed for making the value of Vback higher than that in the full color mode on the condition of the combination of the process speed of the image forming apparatus 100, the moisture content in the image forming apparatus 100, the toner ratio of the developer, the number of sheets used in the developing device 106 and so on.

<Sixth Embodiment> Next, an image forming apparatus according to another embodiment of the present invention will be explained. This embodiment is basically equivalent to the structure of the image forming apparatus of the first embodiment to fifth embodiment. In the following, only the different part of the image forming apparatus of these embodiments will be explained and duplicate description will be omitted.

In the first embodiment to fifth embodiment, by adjusting the value of Vback of the image forming units 109Y, 109M and 109C, the control is performed to improve fogging in the all contact monochrome mode. In the present embodiment, by detecting the condition in which the degree of fogging deteriorates, the control is performed for determining whether all contact monochrome mode is performed or not.

As an example, the case will be explained where the process speed of the image forming apparatus 100 is used as a parameter. As described above, the degree of fogging deteriorates when the process speed of the image forming apparatus 100 is slow. In this embodiment, the controller 200 determines whether to perform the all contact monochrome mode or the full color mode based on the process speed.

FIG. 19 is a table showing whether the all contact monochrome mode is performed or not in such a case as above.

As shown in the table, when the process speed of the image forming apparatus 100 is slow, the developing devices of the image forming units 109Y, 109M and 109C for colors are kept driven to suppress fogging. In other words, the full color mode is performed without performing the all contact monochrome mode. By this configuration, it is possible to avoid fogging in the all contact monochrome mode. However, the present invention is not limited to these specific values.

Next, an explanation will be made to an operation of the control for suppressing fogging of the present embodiment, taking an example of forming an image successively in the order of a full color image and a monochrome image.

Figure 20:
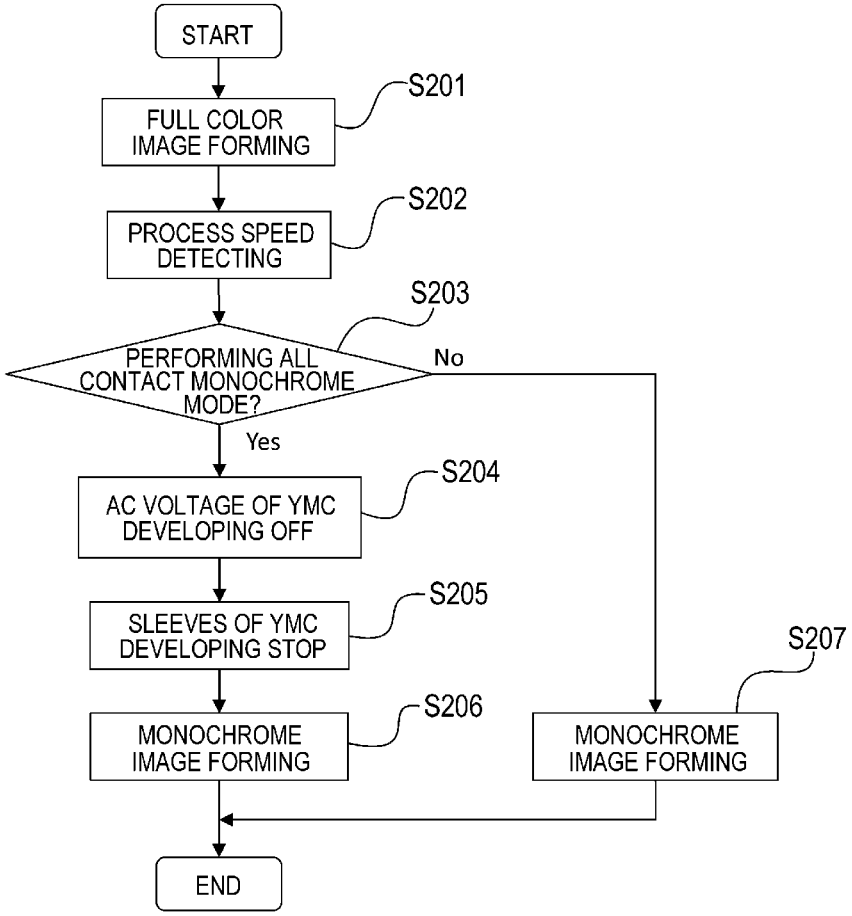
FIG. 20 is a flowchart showing an operation of a fogging countermeasure control of the developing device of the sixth embodiment of the present invention.

FIG. 20 is a flowchart showing an operation for avoiding the generation of fogging in the all contact monochrome mode in the present embodiment.

As shown in the figure, after forming a full color image in the full color mode (step S201), the controller 200 confirms the process speed at the time when a monochrome image is printed (step S202) and determines whether the all contact monochrome mode is performed or not (step S203).

When the all contact monochrome mode is performed (step S203), the controller 200 stops the application of an AC voltage applied to the developing sleeves 13Y, 13M and 13C for colors (step S204) and stops the driving of the developing sleeves 13Y, 13M and 13C (step S205). Thereafter, a monochrome image is formed in the all contact monochrome mode (step S206). When the all contact monochrome mode is not performed (step S203), a monochrome image is formed still in the full color mode following the full color image (step S207).

In this embodiment explained above, when the all contact monochrome mode is not performed, a monochrome image is formed in the full color mode. However, the monochrome image may be formed after switching to the monochrome mode.

As described above, it is determined whether the all contact monochrome mode is performed or not based on a process speed of the image forming apparatus 100. Thus, even when performing a print job in which a full color image and a monochrome image are mixed, it is possible to suppress a short life of the image forming unit 109 without incurring downtime and further to suppress the occurrence of a defective image.

<Seventh Embodiment> Next, an image forming apparatus according to another embodiment of the present invention will be explained. This embodiment is basically equivalent to the structure of the image forming apparatus of the sixth embodiment. In the following, only the different part of the image forming apparatus of the sixth embodiment will be explained and duplicate description will be omitted.

In the sixth embodiment, it is determined whether the all contact monochrome mode is performed or not based on a process speed of the image forming apparatus 100. In this embodiment, it is determined whether the all monochrome mode is performed or not based on a parameter of a moisture content of the image forming apparatus 100, a toner ratio of the developer or a number of sheets used in the developing device 106. It may be determined whether the all monochrome mode is performed or not based on a combination of a plurality of parameters mentioned above.

<Eighth Embodiment> Next, an image forming apparatus according to another embodiment of the present invention will be explained. This embodiment is basically equivalent to the structure of the image forming apparatus of the first embodiment to the seventh embodiment. In the following, only the different part of the image forming apparatus of these embodiments will be explained and duplicate description will be omitted.

In the first embodiment to the seventh embodiment, when the controller 200 detects the condition that the degree of fogging deteriorates, the fogging countermeasure control is performed in the all contact monochrome mode.

In this embodiment, the setting of application of a high voltage applied to the developing sleeves 13Y, 13M and 13C in the all contact monochrome mode and whether the all contact monochrome mode is performed or not are selectable with the operation portion 201 in order for a user to take a countermeasure for fogging in the all contact monochrome mode.

As explained above, according to the present invention, when forming a monochrome image following a full color image, the monochrome image is formed in a first monochrome mode in which an intermediate transfer member is in contact with a plurality of image forming units and a toner image is formed in only one of the plurality of image forming units. The potential difference between the image bearing members of the image forming units other than the only one image forming unit and a developing device is controlled based on at least one of the process speed of the image forming apparatus, the temperature and humidity environment, the toner ratio of the developer and the number of recording materials formed by the developing device. Thus, even when performing a print job in which a full color image and a monochrome image are mixed, it is possible to suppress a short life of the image forming unit without incurring downtime and to suppress the occurrence of an image defect such as an "image fogging".

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-192143, filed on Sep. 22, 2014 which is hereby incorporated by reference herein in its entirety.

What is claimed is:

1. An image forming apparatus, comprising:

a first image forming unit for forming an image by using black toner;

a second image forming unit for forming an image by using color toner;

an intermediate transfer member on which an image formed by the first image forming unit and the second image forming unit is transferred; and a controller configured to control the first image forming unit and the second image forming unit, wherein the first image forming unit and the second image forming unit each respectively include:

an image bearing member;

a charging device which charges the image bearing member; and a developing device which develops the image bearing member on which a latent image is formed after being charged while applying at least a DC bias to the image bearing member, wherein the controller is capable of performing the following modes:

(1) a color mode in which color image formation is performed by using the first image forming unit and the second image forming unit, with the first image forming unit and the second image forming unit being in contact with the intermediate transfer member;

(2) a first monochrome mode in which monochrome image formation is performed by using the first image forming unit and not using the second image forming unit in a state that the first image forming unit and the second image forming unit are in contact with the intermediate transfer member; and (3) a second monochrome mode in which image formation is performed by using the first image forming unit and not using the second image forming unit in a state that the first image forming unit is in contact with the intermediate transfer member and the second image forming unit is separated from the intermediate transfer member, and wherein during an image forming job in which image forming is performed on a plurality of recording materials, in a case where the monochrome image formation is performed after the color image formation in the color mode, the controller determines whether the first monochrome mode or the second monochrome mode is performed based on an image forming speed which is set when the monochrome image formation is performed.

2. The image forming apparatus according to claim 1, wherein the controller performs the second monochrome mode when the image forming speed to be performed is lower than a predetermined speed and the controller performs the first monochrome mode when the image forming speed to be performed is higher than the predetermined speed.

3. An image forming apparatus, comprising:

a first image forming unit for forming an image by using black toner;

a second image forming unit for forming an image by using color toner;

an intermediate transfer member on which an image formed by the first image forming unit and the second image forming unit is transferred; and a controller configured to control the first image forming unit and the second image forming unit, wherein the first image forming unit and the second image forming unit each respectively include:

an image bearing member;

a charging device which charges the image bearing member; and a developing device which develops the image bearing member on which a latent image is formed after being charged while applying at least a DC bias to the image bearing member, wherein the controller is capable of performing the following modes:

(1) a color mode in which color image formation is performed by using the first image forming unit and the second image forming unit, with the first image forming unit and the second image forming unit being in contact with the intermediate transfer member;

(2) a first monochrome mode in which monochrome image formation is performed by using the first image forming unit and not using the second image forming unit in a state that the first image forming unit and the second image forming unit are in contact with the intermediate transfer member; and (3) a second monochrome mode in which image formation is performed by using the first image forming unit and not using the second image forming unit in a state that the first image forming unit is in contact with the intermediate transfer member and the second image forming unit is separated from the intermediate transfer member, and wherein during an image forming job in which image forming is performed on a plurality of recording materials, in a case where the monochrome image formation is performed after the color image formation in the color mode, the controller determines whether the first monochrome mode or the second monochrome mode is performed based on information regarding absolute humidity.

4. The image forming apparatus according to claim 3, wherein the first monochrome mode is performed when the absolute humidity is less than a predetermined value and the second monochrome mode is performed when the absolute humidity is greater than the predetermined value.

5. An image forming apparatus, comprising:

a first image forming unit for forming an image by using black toner;

a second image forming unit for forming an image by using color toner;

an intermediate transfer member on which an image formed by the first image forming unit and the second image forming unit is transferred; and a controller configured to control the first image forming unit and the second image forming unit, wherein the first image forming unit and the second image forming unit each respectively include:

an image bearing member;

a charging device which charges the image bearing member; and a developing device which develops the image bearing member on which a latent image is formed after being charged while applying at least a DC bias to the image bearing member, wherein the controller is capable of performing the following modes:

(1) a color mode in which color image formation is performed by using the first image forming unit and the second image forming unit, with the first image forming unit and the second image forming unit being in contact with the intermediate transfer member;

(2) a first monochrome mode in which monochrome image formation is performed by using the first image forming unit and not using the second image forming unit in a state that the first image forming unit and the second image forming unit are in contact with the intermediate transfer member; and (3) a second monochrome mode in which image formation is performed by using the first image forming unit and not using the second image forming unit in a state that the first image forming unit is in contact with the intermediate transfer member and the second image forming unit is separated from the intermediate transfer member, and wherein during an image forming job in which image forming is performed on a plurality of recording materials, in a case where the monochrome image formation is performed after the color image formation in the color mode, the controller determines whether the first monochrome mode or the second monochrome mode is performed based on information regarding usage of the developing device of the second image forming unit.

6. The image forming apparatus according to claim 5, wherein the first monochrome mode is performed when a number of image formations by the developing device of the second image forming unit is less than a predetermined number and the second monochrome mode is performed when the number of image formations by the developing device of the second image forming unit is greater than the predetermined number.

7. The image forming apparatus according to claim 5, wherein the controller performs the first monochrome mode when a toner ratio of the developing device of the second image forming unit is less than a predetermined value and the controller performs the second monochrome mode when the toner ratio of the developing device of the second image forming unit is greater than the predetermined value.

8. An image forming apparatus, comprising:

a first image forming unit for forming an image by using black toner;

a second image forming unit for forming an image by using color toner;

an intermediate transfer member on which an image formed by the first image forming unit and the second image forming unit is transferred; and a controller configured to control the first image forming unit and the second image forming unit, wherein the first image forming unit and the second image forming unit each respectively include:

an image bearing member;

a charging device which charges the image bearing member; and a developing device which develops the image bearing member on which a latent image is formed after being charged while applying at least a DC bias to the image bearing member, wherein the controller is capable of performing the following modes:

(1) a color mode in which color image formation is performed by using the first image forming unit and the second image forming unit, with the first image forming unit and the second image forming unit being in contact with the intermediate transfer member; and (2) a monochrome mode in which monochrome image formation is performed by using the first image forming unit and not using the second image forming unit in a state that the first image forming unit and the second image forming unit are in contact with the intermediate transfer member, and wherein during an image forming job in which image forming is performed on a plurality of recording materials, in a case where the monochrome image formation in the monochrome mode is performed after the color image formation in the color mode, the controller controls a potential difference between the image bearing member charged by the charging device of the second image forming unit and the developing device of the second image forming unit based on an image forming speed which is to be set when the monochrome image formation is performed.

9. The image forming apparatus according to claim 8, wherein the controller increases the potential difference when the image forming speed to be performed is lower than a predetermined speed and the controller decreases the potential difference when the image forming speed to be performed is higher than the predetermined speed.

10. An image forming apparatus, comprising:

a first image forming unit for forming an image by using black toner;

a second image forming unit for forming an image by using color toner;

an intermediate transfer member on which an image formed by the first image forming unit and the second image forming unit is transferred; and a controller configured to control the first image forming unit and the second image forming unit, wherein the first image forming unit and the second image forming unit each respectively include:

an image bearing member;

a charging device which charges the image bearing member; and a developing device which develops the image bearing member on which a latent image is formed after being charged while applying at least a DC bias to the image bearing member, wherein the controller is capable of performing the following modes:

(1) a color mode in which color image formation is performed by using the first image forming unit and the second image forming unit, with the first image forming unit and the second image forming unit being in contact with the intermediate transfer member; and (2) a monochrome mode in which monochrome image formation is performed by using the first image forming unit and not using the second image forming unit in a state that the first image forming unit and the second image forming unit are in contact with the intermediate transfer member, and wherein during an image forming job in which image forming is performed on a plurality of recording materials, in a case where the monochrome image formation in the monochrome mode is performed after the color image formation in the color mode, the controller controls a potential difference between the image bearing member charged by the charging device of the second image forming unit and the developing device of the second image forming unit based on information regarding absolute humidity.

11. The image forming apparatus according claim 10, wherein the controller decreases the potential difference when the absolute humidity is less than a predetermined value and the controller increases the potential difference when the absolute humidity is greater than the predetermined value.

12. An image forming apparatus, comprising:

a first image forming unit for forming an image by using black toner;

a second image forming unit for forming an image by using color toner;

an intermediate transfer member on which an image formed by the first image forming unit and the second image forming unit is transferred; and a controller configured to control the first image forming unit and the second image forming unit, wherein the first image forming unit and the second image forming unit each respectively include:

an image bearing member;

a charging device which charges the image bearing member; and a developing device which develops the image bearing member on which a latent image is formed after being charged while applying at least a DC bias to the image bearing member, wherein the controller is capable of performing the following modes:

(1) a color mode in which color image formation is performed by using the first image forming unit and the second image forming unit, with the first image forming unit and the second image forming unit being in contact with the intermediate transfer member; and (2) a monochrome mode in which monochrome image formation is performed by using the first image forming unit and not using the second image forming unit in a state that the first image forming unit and the second image forming unit are in contact with the intermediate transfer member, and wherein during an image forming job in which image forming is performed on a plurality of recording materials, in a case where the monochrome image formation in the monochrome mode is performed after the color image formation in the color mode, the controller controls a potential difference between the image bearing member charged by the charging device of the second image forming unit and the developing device of the second image forming unit based on information regarding usage of the developing device of the second image forming unit.

13. The image forming apparatus according to claim 12, wherein the controller decreases the potential difference when a number of image formations by the developing device of the second image forming unit is less than a predetermined number and the controller increases the potential difference when the number of image formations by the developing device of the second image forming unit is greater than the predetermined number.

14. The image forming apparatus according to claim 12, wherein the controller decreases the potential difference when a toner ratio of the developing device of the second image forming unit is less than a predetermined value and the controller increases the potential difference when the toner ratio of the developing device of the second image forming unit is greater than the predetermined value.

* * * * *